US010822223B2

(12) United States Patent
Vannesson et al.

(10) Patent No.: US 10,822,223 B2
(45) Date of Patent: Nov. 3, 2020

(54) MOTION CONTROL DEVICE FOR AN ARTICULATED FLUID-LOADING ARM, ACQUISITION AND CALCULATION METHOD AND DEVICE THEREFOR, AND ARTICULATED FLUID LOADING ARM

(71) Applicant: FMC Technologies, Sens (FR)

(72) Inventors: Adrien Vannesson, Sens (FR); Pierre Besset, Lille (FR); Frédéric Pelletier, Sens (FR)

(73) Assignee: FMC Technologies, Sens (FR)

( * ) Notice: Subject to any disclaimer, the term of this patent is extended or adjusted under 35 U.S.C. 154(b) by 78 days.

(21) Appl. No.: 16/304,266

(22) PCT Filed: May 24, 2017

(86) PCT No.: PCT/EP2017/062688

§ 371 (c)(1),
(2) Date: Nov. 23, 2018

(87) PCT Pub. No.: WO2017/203004

PCT Pub. Date: Nov. 30, 2017

(65) Prior Publication Data

US 2019/0084824 A1 Mar. 21, 2019

(30) Foreign Application Priority Data

May 24, 2016 (FR) ..... 16 54638

(51) Int. Cl.
*B67D 9/02* (2010.01)
*B63B 27/34* (2006.01)
(Continued)

(52) U.S. Cl.
CPC ..... *B67D 9/02* (2013.01); *B63B 27/00* (2013.01); *B63B 27/24* (2013.01); *B63B 27/34* (2013.01)

(58) Field of Classification Search
CPC ..... B67D 9/02; B63B 27/24; B63B 27/34
See application file for complete search history.

(56) References Cited

U.S. PATENT DOCUMENTS 4,408,943 A * 10/1983 McTamaney ..... B63B 27/24 114/74 R
4,769,583 A * 9/1988 Goor ..... G05B 19/237 318/567

(Continued)

FOREIGN PATENT DOCUMENTS

JP 2004137702 A 5/2004

OTHER PUBLICATIONS

Richard Béarée, "New Damped-Jerk Trajectory for Vibration Reduction", Control Engineering Practice 28, pp. 112-120 (Apr. 19, 2014).

*Primary Examiner* — Timothy L Maust

(57) ABSTRACT

Device for controlling the movement of one of the ends of an articulated fluid loading arm from a storage position to a target pipe (35) and from this target pipe (35) to the storage position, said arm comprising a fluid transfer line equipped at this end with a coupling system (26), the latter being adapted to be coupled to the target pipe (35) for the transfer of the fluid, which device comprises actuators (27-29) for controlling the movement of the arm in space from the storage position until the coupling system (26) is positioned in front of the target pipe (35) for its coupling to the latter, and from the target pipe (35) to the storage position. This device includes calculation means (41) adapted for: —monitoring in real time the movement of the coupling system (26); —generating, in real time, from the last determined position of the coupling system (26) a trajectory of movement of the coupling system (26) in the direction of the target pipe (35) or the storage position, based on a dynamic jerk-limited motion law; —calculating command instructions to be given to each of the actuators (27-29) in order to (Continued)

control the movement of the coupling system (26) based on this motion law.

18 Claims, 2 Drawing Sheets

(51) Int. Cl.
*B63B 27/24* (2006.01)
*B63B 27/00* (2006.01)

(56) References Cited

U.S. PATENT DOCUMENTS 5,331,264 A * 7/1994 Cheng ..... G05B 19/416 318/560
5,426,722 A * 6/1995 Batchelder ..... G05B 19/4103 700/245
5,594,309 A * 1/1997 McConnell ..... B25J 9/163 318/568.2
5,811,952 A * 9/1998 Kato ..... G05B 19/416 318/561
7,076,322 B2 * 7/2006 Chandhoke ..... G05B 19/416 318/560
7,479,751 B2 * 1/2009 Sladek ..... G05B 19/416 318/560
7,919,940 B2 * 4/2011 Miller ..... G05B 19/416 318/163
8,050,800 B2 * 11/2011 Miller ..... G05B 19/416 318/568.11
8,181,662 B2 * 5/2012 Pollack ..... B63B 27/24 137/15.08
10,081,414 B2 * 9/2018 Le Devehat ..... B63B 27/24
2011/0066290 A1 3/2011 Le Devehat et al.

* cited by examiner

MOTION CONTROL DEVICE FOR AN ARTICULATED FLUID-LOADING ARM, ACQUISITION AND CALCULATION METHOD AND DEVICE THEREFOR, AND ARTICULATED FLUID LOADING ARM

BACKGROUND OF THE INVENTION

The present invention generally relates to articulated loading arms for transferring a fluid from one place to another (loading and/or unloading).

Fluid is understood to mean a liquid or gaseous product. It refers more particularly to liquified natural gas, low- and high-pressure natural gas, and petroleum or chemical products transferred between a ship and a dock or between two ships.

More particularly, the present invention relates to devices for controlling the movement, positioning, and coupling (the term "connection" is also used) of such loading arms to a target pipe or their disconnection from the latter.

Generally, such an arm comprises an articulated piping system, mounted on a support and connected to a fluid supply piping system, and on which a first pipe, called an inboard pipe, is mounted via a 90° pipe elbow section enabling a rotation on a vertical axis at one of its ends, and on a horizontal axis at the other end. At the opposite end of the inboard pipe, a second pipe called an outboard pipe is rotatably mounted on a horizontal axis. A coupling assembly is mounted on the end of the outboard pipe.

The coupling assembly thus has at least 3 degrees of freedom in space relative to the support, and the movements in each of these degrees of freedom are controlled by hydraulic, electric, or pneumatic actuators such as jacks or motors.

The motion control is achieved either by means of a command interface controlled by an operator, or fully automatically.

Such arms are known, for example from the patent applications FR2813872, FR2854156, FR2931451, FR2964093 and FR3003855.

The object of the present invention is to propose a transfer arm of the same type, but with improved performance in terms of the connection and disconnection processes, particularly in the context of a fluid transfer on open sea, which has always been difficult due to the relative movements of the floating structures between which the transfer must take place.

Another object of the invention is to do this without the physical linkage and guidance systems known from, for example, the applications FR2813872 and FR2854156.

A further object of the invention is to produce an articulated transfer arm with a limited or non-existent human interface, thus making it possible to perform an automatic or semi-assisted connection or disconnection of this arm.

SUMMARY OF THE INVENTION

The present invention proposes for this purpose a device for controlling the movement of one of the ends of an articulated fluid loading arm from a storage position to a target pipe and from this target pipe to the storage position, said arm comprising a fluid transfer line equipped at this end with a coupling system, the latter being adapted to be coupled to the target pipe for the transfer of the fluid, which device comprises actuators for controlling the movement of the arm in space from the storage position until the coupling system is positioned in front of the target pipe for its coupling to the latter, and from the target pipe to the storage position, and this device being characterized in that it includes calculation means adapted for:

monitoring in real time the movement of the coupling system;

generating, in real time, from the last determined position of the coupling system, a trajectory of movement of the coupling system in the direction of the target pipe or the storage position, based on a dynamic jerk-limited motion law;

calculating command instructions to be given to each of the actuators in order to control the movement of the coupling system based on this motion law.

As a result of these features, it is possible to perform a connection and disconnection process that makes it possible to reduce to a minimum or even avoid producing vibrations or oscillations in the arm during its movement in the direction of the target pipe, and that also provides other advantages, as will be seen in greater detail below.

According to other features of the present invention that can be implemented independently or in combination, particularly due to their ease of production and use:

The step for real-time monitoring of the movement of the coupling system involves a real-time monitoring, during at least part of the movement, of the relative position of the coupling system with respect to the target pipe, the trajectory being generated from the last determined relative position.

The step for real-time monitoring of the relative position of the coupling system with respect to the target pipe also involves a real-time monitoring of the relative orientation of the coupling system with respect to the target pipe, the trajectory being generated from the last determined relative position and orientation;

When the target pipe is installed on a floating structure, and the loading arm is installed on a fixed or floating structure, the calculation means are linked to measurement means for the real-time monitoring of the absolute or relative movements of the floating structure or structures in all 6 degrees of freedom simultaneously;

The measurement means are chosen from the group comprising inertial units, GPS, GPS adapted to perform relative position monitoring, cameras, inclinometers, accelerometers, potentiometers, sonar, laser trackers, tacheometers, or a combination thereof;

The calculation means comprise prediction functions adapted for predicting (i) the progress of the movement of the coupling system and/or (ii) the behavior of the articulated loading arm in relation to the jerk-limited movement command that is applied to it; and are adapted for adjusting the dynamic jerk-limited motion law so that it takes the prediction into account;

The calculation means use, for the monitoring, a kinematic model of the arm that compensates for real dimensional, deformation, and/or position errors;

The kinematic model of the arm is obtained by a calibration procedure and an adjustment of the parameters of a model of the loading arm incorporating these errors;

The adjustment is performed by means of nonlinear optimization algorithms, or by training a neural network, or by any other method of the same type, using measurements obtained by the calibration procedure;

The calculation means are adapted to apply command instructions to each of the actuators so that the movement induced by each of the actuators is simultaneous and has the same duration;

The calculation means are adapted to apply command instructions for maintaining jerk-limited motion in the various modes of control, i.e. automatic, or manual by the operator via a command interface, or a semi-automatic mode combining the manual and automatic commands;

The control device also includes active vibration damping means, adapted to superimpose a vibration set point on the command instructions applied to the actuators;

The calculation means are also adapted to generate the trajectory so as to avoid collisions between the arm and an element or structure in the surroundings.

The present invention also relates to a data acquisition and calculation device for a control device as defined above, characterized in that it is adapted for:

monitoring in real time the relative position of the connect/disconnect element with respect to the target pipe;

generating, in real time, from the last relative position generated, a trajectory of movement of the connect/disconnect element in the direction of the target pipe based on a dynamic jerk-limited motion law;

calculating command instructions given to each of the actuators in order to control the movement of the connect/disconnect element in the direction of the target pipe based on this motion law.

The invention further relates to a method for transferring fluid by means of an arm as defined above, comprising the steps consisting of:

monitoring in real time the movement of the coupling system;

generating, in real time, from the last determined position of the coupling system, a trajectory of movement of the coupling system in the direction of the target pipe or the storage position, based on a dynamic jerk-limited motion law;

calculating command instructions to be given to each of the actuators in order to control the movement of the coupling system based on this motion law.

Advantageously, the method also comprises the steps consisting of:

predicting (i) the progress of the movement of the coupling system and/or (ii) the behavior of the articulated loading arm in relation to the movement command that is applied to it, and adjusting the dynamic jerk-limited motion law so that it takes the prediction into account.

Lastly, the invention relates to an articulated loading arm comprising a control device as defined above.

The disclosure of the present invention will now be followed by the detailed description of exemplary embodiments, given below as a nonlimiting illustration, in reference to the attached drawings.

DETAILED DESCRIPTION OF THE INVENTION

Figure 1:
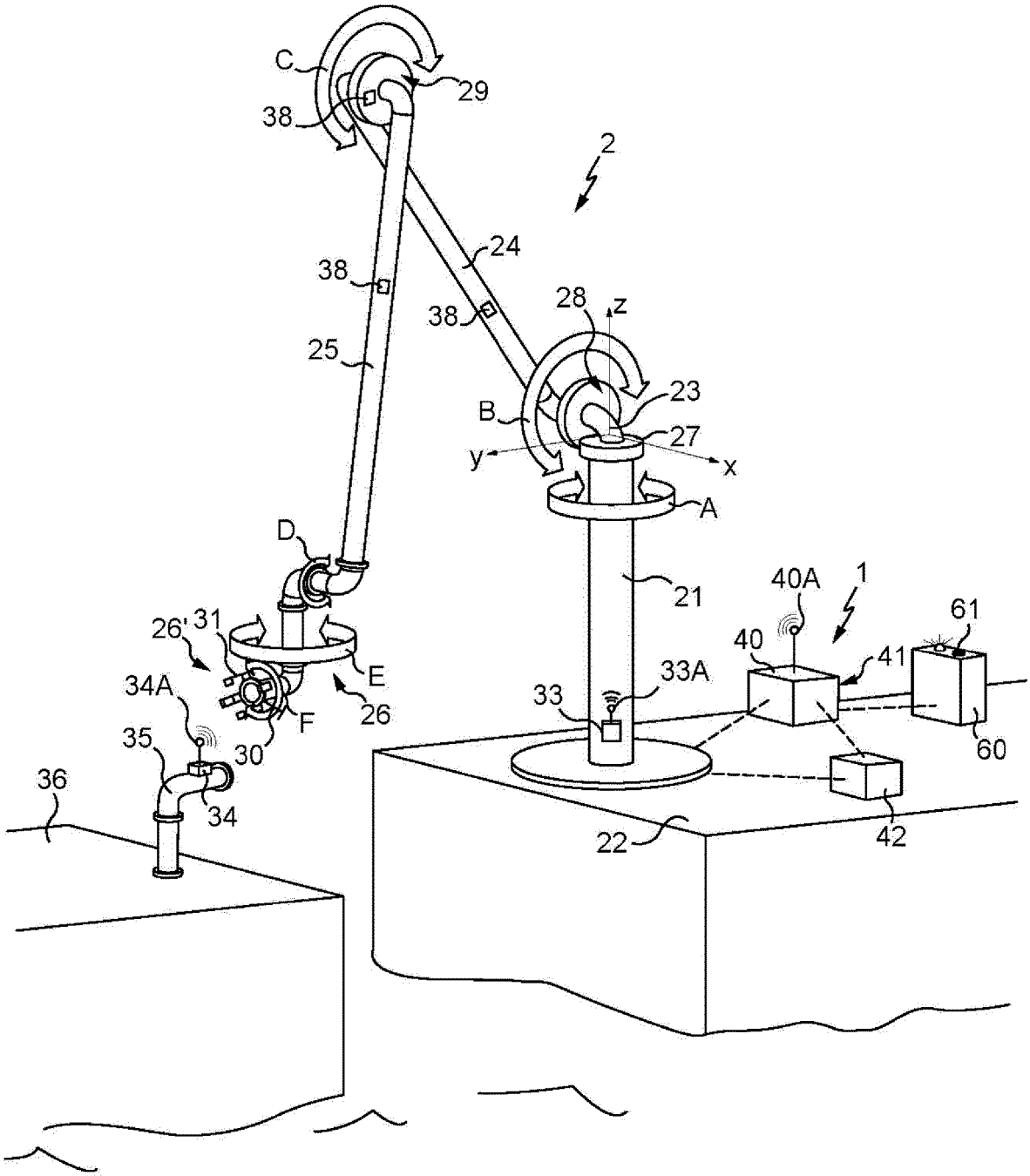
FIG. 1 is a schematic perspective view of a loading arm equipped with a control device according to the invention.

FIG. 1 illustrates, very schematically, a loading arm 2 equipped with a control device 1 according to the invention. The articulated loading arm here is illustrated in a very simplified way, and accordingly, it is noted that the control device according to the invention adapts to any articulated loading arm system, particularly to the marine loading arms of the above-mentioned patent applications.

In general, this type of loading arm is intrinsically known, and will not be described in detail here.

The loading arm of FIG. 1 is a marine loading arm that has a base 21 connected to a fluid supply line that is located underneath the surface of the structure 22 to which the base is attached. In the present case, it is a floating structure such as a ship, but according to a variant, it could be a dock. Rotatably articulated to the top end of the base is a pipe elbow 23, to which in turn is articulated a first pipe, called an inboard pipe 24, to whose opposite end is articulated a second pipe, called an outboard pipe 25. The end of the outboard pipe carries a coupling assembly 26 that also enables the fluid transfer, and whose coupling system 26', also called the coupler, is intended to be connected to a target pipe 35, in this case a manifold, disposed in the present example on a ship 36, illustrated very schematically. In the embodiment illustrated, in an intrinsically known way, the coupler 26' also has three degrees of freedom in rotation relative to the end of the outboard pipe 25. These three degrees of rotation are either free, so that an operator can freely adjust the angle of the coupler during the final approach phase for the coupling of the coupler to the pipe, or one or more of these rotations are controlled by actuators and linked to a controller for a fully or partially automatic positioning, and/or to a command interface to enable the operator to control the rotations directly during the final approach of the coupler. As described in further detail below, two of the rotations (double arrows 0 and E) in this case are controlled, while the third (double arrow F) is free.

In an intrinsically known way, the coupler 26' in this exemplary embodiment has locking clamps 31 that are locked by an actuator 30, illustrated very schematically, so as to maintain the coupler 26' around the target pipe 35 once it is connected.

The assemblies used here are formed of swivel connectors or joints and elbows, particularly of the type comprising, on one hand, a swivel connector or joint whose two ends are each welded to an elbow, and on the other hand, the combination of a first swivel connector, followed by an elbow, followed by second swivel connector forming a 90° angle with said first connector, followed by an elbow. Another assembly (like the one that allows the rotations along the double arrows D, E, F in FIG. 1) corresponds to the second one with the addition of a third connector joined to the second one by an elbow. The swivel joints of these assemblies in this case are all cryogenic.

The 90° pipe elbow sections described above and used to connect the inboard 24 and outboard 25 pipes to one another, the inboard pipe 24 to the base 21, and the coupling assembly 26 to the outboard pipe 25 are also assemblies of this type.

The articulated tubular section 24, 25, is generally associated with counterweight balancing systems (not shown here), which may or may not be associated with mechanisms of the balanced pantograph type.

At the end of the transfer line equipped with the coupling assembly, an Emergency Release System (ERS) and a Quick Connect/Disconnect Coupler (QCDC) may be provided.

Figure 2:
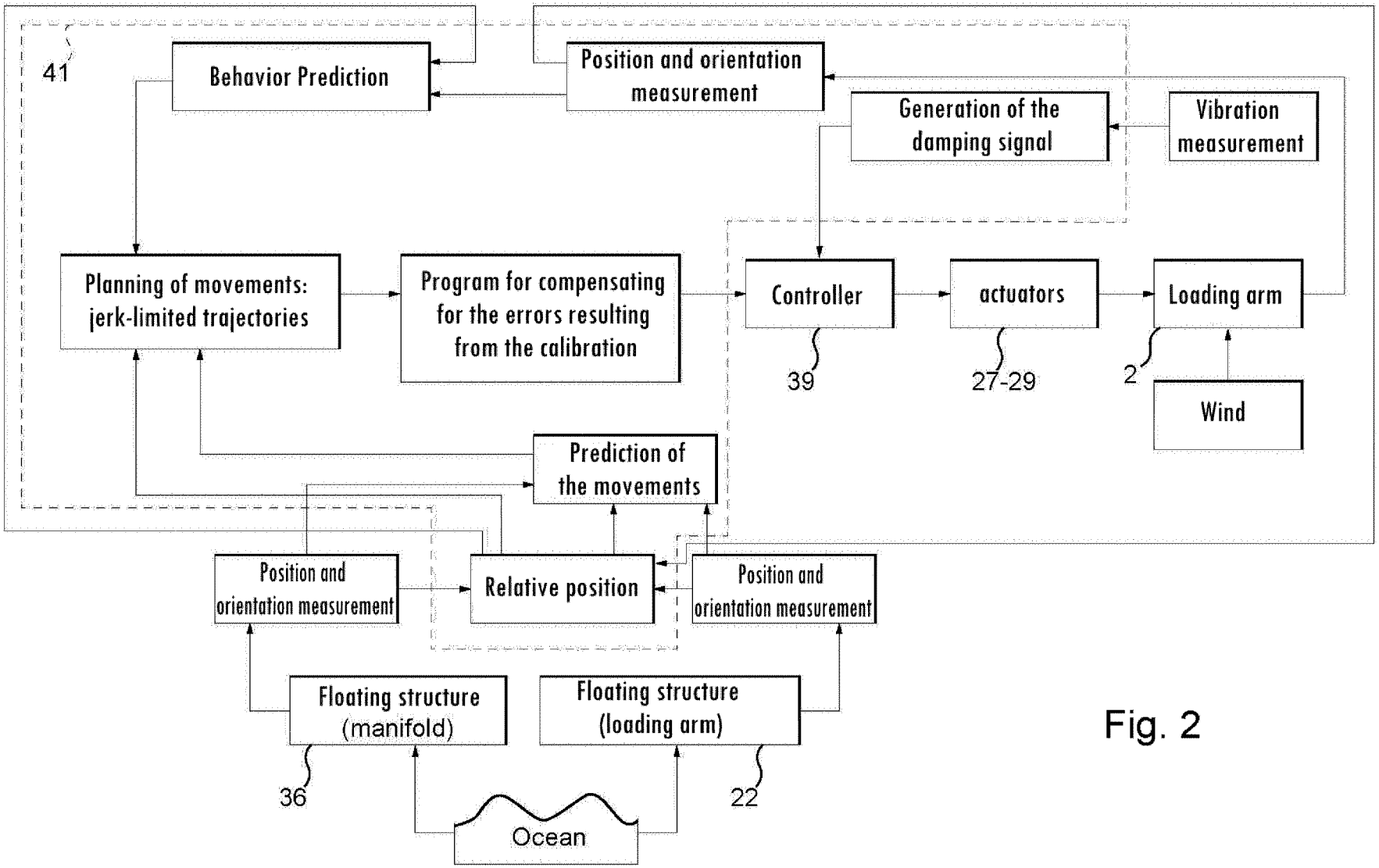
FIG. 2 is a block diagram of the operation of the device according to FIG. 1.

We will now describe in greater detail, in reference to FIGS. 1 and 2, the operation of such an arm equipped with the control device according to the present invention.

In the invention as illustrated schematically in FIGS. 1 and 2, actuators 27, 28, 29 are provided for each of the three articulations of the loading arm (symbolized by the double arrows A, B, C) in order to drive, directly or via a transmission, the inboard pipe and the outboard pipe and to generate the rotation around a vertical axis. More precisely, in this case, a first actuator 27 is provided between the top end of the base 21 and the pipe elbow 23, in order to pivot the latter horizontally relative to the base, a second actuator 28 is provided between the end of the pipe elbow 23 and the inboard pipe 24, in order to pivot the inboard pipe vertically, and a third actuator 29 is provided between the inboard pipe 24 and the outboard pipe 25, in order to pivot the latter vertically.

The three actuators 27, 28, 29, and those that drive the swivel joints of the assembly 26 around the double arrows D, E, F, in this case are hydraulic jacks, illustrated very schematically in FIG. 1. In a variant, not illustrated, one or more of the hydraulic jacks are replaced with other types of hydraulic, pneumatic or electric actuators, such as motors, jacks, or any other type of actuator.

The target pipe 35 provided on the ship 36, in this case is equipped with a housing 34 containing a measurement means which, in the present exemplary embodiment, is an inertial unit associated with a GPS.

The same is true for the base 21 (support of the loading arm), which in this case has a housing 33 containing another inertial unit associated with a GPS.

The calculation means of the control device are incorporated into a controller 41 disposed in an electric control box 40.

More precisely, the controller is a Programmable Logic Controller (PLC). It is adapted for processing the signals received from measurement means, using preprogrammed algorithms. In a variant, it can be a data acquisition and calculation unit of the industrial computer type, and more generally, a data acquisition and calculation device.

A hydraulic power unit 42 is provided to supply the actuators with the hydraulic energy required for their operation. It is controlled by the controller 41. Of course, this is only applicable if the actuators in question are hydraulic.

Each of the assemblies formed of inertial units and GPS is respectively provided with a radio transmitting device 33A and 34A for transmitting a signal comprising the measurement information.

In a variant, the unit 33 can be wired directly to the controller 41.

The controller 41 is connected to a receiving device 40A, which is a radio receiver adapted for communicating with the radio transmitting devices 33A and 34A, respectively connected to the housings 33 and 34 of each of the ships.

The control device in this case also includes a command interface 60 for an operator.

The measurement systems, in this case formed by a combination of inertial units and GPS, thus provide the orientation (yaw, pitch, and roll) and the movement (heave, sway and surge) of each ship in real time. In other words, these inertial units and GPS make it possible to monitor the movements of both ships in all 6 degrees of freedom simultaneously.

In an alternative embodiment, the inertial units and GPS can be replaced, for example, by a laser tracker, a camera, or any other measurement means for determining the relative position of the coupler with respect to the target pipe and, if necessary, the relative orientation of one with respect to the other (in the case of floating structures as in this example) (see also above for the means that can be used). It will also be noted that measurement means such as inertial units or GPS can be equipped with additional means for switching from absolute position monitoring to relative monitoring. This could be, for example, a moving base GPS.

The loading arm itself is equipped with sensors disposed on the structure and/or the actuators, making it possible to determine its configuration at any time. In this case, the sensors are inclinometers 38, but they could also, in a variant, be encoders or other equivalent measurement means.

Using geometric calculations based on the information from the sensors installed on the arm (encoders, inclinometers, or other sensors), and knowing the actual dimensions of the loading arm as a result of a calibration described below, it is relatively simple to calculate the theoretical position of the coupler 26', in this case relative to the support of the arm. Thus, by combining the measurement of the configuration of the arm with the measurements of the orientations and movements of the ships, the relative position of the coupler 26' relative to the target pipe 35 is determined by means of the controller (in Cartesian coordinates).

In fact, via the above-mentioned measurements, we have the relative position of the target pipe 35 with respect to the base, the relative position of the coupler 26' with respect to that same base, and consequently, the relative position of the coupler 26' with respect to the target pipe 35.

The coupling assembly in this case also being equipped with measurement means such as encoders and inclinometers, here again we have the relative orientation of the coupler 26' with respect to the target pipe (whose orientation is determined by means of the inertial unit of the housing 34). More precisely, what is measured in this case are the angular positions of the swivel joints that enable the rotations around the double arrows D and E.

As described in detail below, when a camera at the level of the coupler and a target at the level of the pipe are the only measurement means used, the relative position is measured directly, unlike in the present embodiment, which uses a combination of inertial units and GPS.

The combinations of measurement means (inertial units and GPS, for example) are used to increase precision, and consequently security, thanks to data merging algorithms of the Kalman filter or neural network type. This also makes it possible to increase reliability.

According to the present invention, the command programs of the controller 41 are used to guide the loading arm along special trajectories, specifically characterized by their "smoothness." In this case, it is a jerk-limited trajectory (derived from the acceleration), which has the property of having a low frequency content compared to the usual trajectories, thus inducing fewer oscillations in the loading arm, and particularly in the swivel joints of the coupling assembly.

Moreover, these trajectories can be calculated so as to take into account the vibration frequencies of the loading arm, in order to avoid exciting them.

In addition, these trajectories according to the invention are characterized by their dynamic generation. They must actually be able to be generated in real time in order to adapt to the environment (particularly the movements of the target pipe). In other words, the trajectory-generating controller is adapted so as to take into account the current speed and acceleration of the loading arm in order to create a trajectory that will not create any discontinuity in acceleration that might produce vibrations.

In fact, in order to drive the loading arm in a marine environment, specific trajectories are needed. By "dynamic" (or "online"), it is meant that the trajectory planning algorithm admits non-zero initial state. In other words, dynamic trajectory planning enables the loading arm to update the trajectory which is being followed with no need for the system to stop. Dynamic trajectory planning is needed because the future motion of the manifold is unknown, thus the trajectory of the coupler must be constantly updated.

Loading arms have particularly flexible structures which oscillate very easily under their actuation systems or external disturbances. Such oscillation keeps the system from working because it leads to an important loss of accuracy. For that reason, the trajectory planning algorithm used to drive the loading arm should produce jerk-limited trajectories in order to limit the vibration induced in the structure of the loading arm.

Together, it comes that the appropriate trajectories for driving the loading arm should both be dynamic and jerk-limited. The scientific literature proposes different approaches to compute such dynamic jerk-limited trajectories [1, 2]. However, to the latter methods is preferred, here, the one presented in [3]. Indeed [3] proposes a method to generate dynamic jerk-limited trajectories that include extra damping properties, which make it possible to greatly reduce vibrations in the system.

REFERENCES

[1] HASCHKE, Robert, WEITNAUER, Erik, et RITTER, Helge. On-line planning of time-optimal, jerk-limited trajectories. In: Intelligent Robots and Systems, 2008. IROS 2008. IEEE/RSJ International Conference on. IEEE, 2008. p. 3248-3253.

[2] KROGER, Torsten, TOMICZEK, Adam, et WAHL, Friedrich M. Towards on-line trajectory computation. In: Intelligent Robots and Systems, 2006 IEEE/RSJ International Conference on. IEEE, 2006. p. 736-741.

[3] BESSET, Pierre, BEAREE, Richard, et GIBARU, Olivier. FIR filter-based online jerk-controlled trajectory generation. In: Industrial Technology (ICIT), 2016 IEEE International Conference on. IEEE, 2016. p. 84-89.

Equally advantageously, it is desirable for the trajectories of the swivel joints (i.e., when the trajectory of the coupler is split in order to be injected into the various actuators of the arm) to have the same duration, in order to "smooth" the movements of coupler. The command programs of the controller can also be parameterized to incorporate such a synchronization function.

The controller chosen must therefore be fast enough to operate in real time.

However, when it comes to the position of the coupler, determined as indicated above, it should be noted that:

the real dimensions generally differ from the nominal dimensions. There is therefore an error in the estimate of the position of the coupler;

the elements of the loading arm deform, and the deflections caused by the flexion and torsion phenomena induce an additional error;

thermal dilation also enters into play; and the axes of rotation are theoretically collinear, but not exactly so.

These errors accumulate and in practice can add up to several tens of centimeters.

The present embodiment therefore provides for a calibration, which is an experimental procedure that consists of finding a mathematical formula that makes it possible to compensate for these errors, for more precise positioning.

In practice, this calibration procedure consists of directly measuring the position of the coupler (for example by means of a laser tracker, a camera or another appropriate measurement means) for a large number of configurations of the arm. Based on these measurements, and with the aid of nonlinear optimization algorithms (for example of the Levenberg-Maquardt type), the parameters of a model of the arm incorporating the errors are adjusted. Another solution consists of training a neural network based on these measurements.

In practice, the controller 41 incorporates a program for compensating for the errors determined during the calibration.

The command programs of the controller, which are described in greater detail below, can thus include a kinematic model of the loading arm, in order to improve the precision of movement of this loading arm via a program for compensating for the errors resulting from the calibration after the planning of the movements described above. In a variant, in a simplified model, these command programs can take into account only theoretical parameters of the loading arm.

In the case of the present embodiment of the invention, means are also provided for making a prediction of the progress of the relative position of the coupler with respect to the target pipe, making it possible to compensate for delays linked to the information stream and to the dynamics of the arm. Such a prediction can be even more important when the arm has a slow dynamics relative to the movements of the target pipe. Such means can implement autoregressive statistical models, a Fourier decomposition analysis, or preferably given their performance, neural networks, and can be used to adjust the motion profile followed by the coupler.

In practice, by using in a trajectory planning algorithm the predicted orientation and movement (from the measurement of the movements done when planning the movements of the arm) of the ship carrying the arm, it is also possible to take advantage of possible inertial effects, in order to reduce the energy consumption of the arm and the stresses in the swivel joints.

These prediction means are also adapted for predicting the dynamic behavior of the articulated loading arm in relation to the movement command that is applied to it (control) in order to adjust the motion profile of the coupler accordingly.

In practice, they are specifically based on actual measurements of the movement of the arm, as described above, and on its dimensional characteristics.

The present embodiment of the invention also implements an active vibration damping program by means of the controller. Such a program is used to damp, or even eliminate, any vibration induced by external disturbances (wind, etc.).

In this case, the actuators of the arms are advantageously used to eliminate these vibrations. In practice, the controller is parameterized to superimpose a vibration set point on the normal command instructions of the actuators. This vibration set point is adapted to produce vibrations equal and opposite to the vibrations already present in the arm and measured, in order to cancel them out.

In the present embodiment, the oscillations of the swivel joints and elbows of the coupling assembly 26 are measured, in particular, by sensor so that the resulting information can be used for the active damping of their oscillations. The sensor can be an encoder, an inclinometer, or any other equivalent measurement means.

When the swivel joints of the assembly are not controlled by one or more actuators, it is possible to act on these oscillations by moving the pipe 25.

In an alternative embodiment, if the actuators already present in the arm are insufficient, additional actuators can be used, such as for example piezoelectric elements. These can be disposed, for example, on the pipes 24 and 25 or in the joints.

In practice, the vibration signal is measured. In order to damp it or cancel it out, an opposite phase vibration (phase difference of 180°) is generated so that the sum is zero. This phase difference corresponds to a derivative "damping" term. Depending on the part of the arm that is vibrating/oscillating, one or more actuators are used to generate the right vibration.

Advantageously, a collision avoidance program can also be integrated into the controller in order to prevent collisions between several loading arms, when such is the case, or with elements located in the working area of the loading arm.

It will also be noted that the actuators 27, 28, 29 are connected to a controller 39 that is itself connected to the controller 41. More precisely, it is a PID (proportional, integral, derivative) corrector that generates flow set points.

The valves that make it possible to control the actuators are not shown in the figure for the sake of clarity.

In an alternative embodiment, a return of information from the actuators to the controller can also be provided in order to indicate whether they have actually reached their set point position.

It is also noted that the hydraulic power unit 42 provides the actuators with the hydraulic energy required for their operation. It is also controlled by the controller via power relays for controlling the startup and shutoff of the hydraulic unit. The hydraulic unit comprises a pump (not shown) for pumping a hydraulic fluid to feed the actuators.

Of course, this is only applicable in the case of hydraulic actuators.

The command interface 60 is connected to the controller in order to enable an operator to control the coupling of the coupler to the target pipe. In practice, it can be a simple button 61, as is the case in the present embodiment, for an automatic connection procedure.

In a variant, the button on the command interface 60 can be replaced by a joystick for purposes of a manual coupling, the optimal trajectory being calculated based on instructions given by the operator.

A semi-automatic connection is also possible. The trajectory for the semi-automatic mode is defined by the controller, and the operator simply gives the instructions to move forward or backward along this trajectory (recalculated in real time).

Thus, in practice, the controller 41 monitors in real time the relative position of the coupler with respect to the target pipe, and in this case also their relative orientation, then generates, in real time, from the last determined relative position and orientation, a trajectory of movement of the coupler in the direction of the target pipe based on the jerk-limited motion profile. It then calculates the command instructions to be given to each of the actuators in order to control the movement of the coupler in the direction of the target pipe from the storage position of the arm, based on this motion profile and the above-mentioned specific characteristics.

It therefore calculates in real time the remaining distances between the coupler and the target pipe along the axes X, Y and Z, schematically illustrated in FIG. 1.

If these three distances are not zero, or equal to distances parameterized as known reference distances for the coupling (for example when the final approach is not handled by the controller itself), the controller calculates the command instructions for each of the actuators of the arm so that their combined movements result in a movement of the coupler for moving the coupler toward the target pipe along the three axes. The controller then applies the command instructions calculated for each actuator to the actuators. It also calculates in real time the remaining distances between this coupler and the target pipe along the axes X, Y and Z. If these distances are still not zero or equal to the parameterized distances, the controller recalculates the instructions for the actuators and applies them until these distances are zero or equal to the parameterized distances.

If all three distances are zero or are equal to the parameterized distances, it means that the coupler is facing the target pipe in the coupling position. The controller can also send, particularly as part of a fully automatic connection procedure, a command instruction to the actuator 30 of the coupler to lock the coupler to the target pipe, followed by an instruction to release the actuators from the arm in order to free up the movements of the arm once the coupler is connected and locked onto the target pipe.

In the opposite direction, during the disconnection process (the return of the coupler to its storage position), the jerk-limited motion profile is also applied to prevent vibrations from being generated in the coupling assembly, which could, in particular, cause the latter to bang against the ship carrying the target pipe 35 at the start of the return. Moreover, the trajectory is defined so as to avoid any risk of collision with the target pipe 35 or any other element of the ship.

The relative position of the coupler 26' with respect to the target pipe 35 is therefore monitored at the start of the process of returning to the storage position.

Many other variants are possible depending on the circumstances, and accordingly, it is noted that the present invention is not limited to the illustrated examples described.

For example, in the case of a laser tracker, a laser device comprises a laser transmitter and a target, the device being adapted to determine, by means of a laser beam, the relative position of the coupler with respect to the target pipe. In another embodiment, a camera and a target, such as a reflective test target, could be used for this purpose.

Furthermore, it is possible to use only two inertial units or equivalent means for the determination of the relative position of the coupler with respect to the target pipe, without determining the configuration of the arm, in order to monitor this relative position in real time, then generate, in real time, a trajectory of movement based on a jerk-limited motion profile.

In addition, the loading arm can include one or more transfer lines with two or more sections connected to each other by the sealed joints defined above.

The controller can also be replaced, more generally, by a computer.

It is to be noted that the control device according to the invention adapts to all articulated loading arms, and that adapting the control device according to the invention to any other type of loading system is within the capacity of a person of ordinary skill in the art.

The invention claimed is:

1. A device for controlling the movement of a first end of an articulated fluid loading arm from a storage position to a target pipe and from the target pipe to the storage position, said arm comprising a fluid transfer line equipped at the first end with a coupling system adapted to be coupled to the target pipe for the transfer of the fluid, which device comprises actuators for controlling the movement of the arm in space from the storage position until the coupling system is positioned in front of the target pipe for its coupling to the target pipe, and from the target pipe to the storage position, the device including calculation means adapted for:

monitoring in real time the movement of the coupling system;

generating, in real time, from a last determined position of the coupling system a trajectory of movement of the coupling system in the direction of the target pipe or the storage position, based on a dynamic jerk-limited motion law;

calculating command instructions to be given to each of the actuators in order to control the movement of the coupling system based on the dynamic jerk-limited motion law.

2. The device according to claim 1, wherein for real-time monitoring of the movement of the coupling system, the calculation means is adapted for real-time monitoring, during at least part of the movement of the coupling system, of the relative position of the coupling system with respect to the target pipe, the trajectory being generated from the last determined relative position.

3. The device according to claim 2, wherein for real-time monitoring of the relative position of the coupling system with respect to the target pipe, the calculation means is adapted for real-time monitoring of the relative orientation of the coupling system with respect to the target pipe, the trajectory being generated based on the relative position and the relative orientation that were last determined.

4. The device according to claim 3, wherein when the target pipe is installed on a floating structure, and the fluid loading arm is installed on a fixed or floating structure, the calculation means are linked to measurement means for the real-time monitoring of the absolute or relative movements of the floating structure or structures in all 6 degrees of freedom simultaneously.

5. The device according to claim 4, wherein the measurement means are chosen from the group comprising GPS, GPS adapted to perform relative position monitoring, cameras, inclinometers, accelerometers, potentiometers, sonar, laser trackers, tachometers, or a combination thereof.

6. The device according to claim 1, wherein the calculation means comprise prediction functions adapted for predicting at least one of (i) the progress of the movement of the coupling system and (ii) the behavior of the fluid loading arm in relation to the dynamic jerk-limited movement command that is applied to it, and wherein the calculation means are adapted for adjusting the dynamic jerk-limited motion law so that it takes the prediction into account.

7. The device according to claim 1, wherein the calculation means use, for the monitoring, a kinematic model of the arm that compensates for at least one of real dimensional, deformation, and position errors.

8. The device according to claim 7, wherein the kinematic model of the arm is obtained by a calibration procedure and an adjustment of the parameters of a model of the fluid loading arm incorporating these errors.

9. The device according to claim 8, wherein the adjustment is performed by means of nonlinear optimization algorithms, or by training a neural network, using measurements obtained by the calibration procedure.

10. The device according to claim 1, wherein the calculation means are adapted to apply command instructions to each of the actuators so that the movement induced by each of the actuators is simultaneous and has the same duration.

11. The device according to claim 1, wherein the calculation means are adapted to apply command instructions for maintaining jerk-limited motion in the various modes of control, i.e. automatic, or manual by the operator via a command interface, or a semiautomatic mode combining the manual and automatic commands.

12. The device according to claim 1, further comprising active vibration damping means adapted to superimpose a vibration set point on the command instructions applied to the actuators.

13. The device according to claim 1, wherein the calculation means are also adapted to generate the trajectory so as to avoid collisions between the arm and an element or a structure in the surroundings.

14. A data acquisition and calculation device for a device according to any of the preceding claims, the data acquisition and calculation device being adapted for:

monitoring in real time the movement of the coupling system;

generating, in real time, from the last determined position of the coupling system, a trajectory of movement of the coupling system in the direction of the target pipe or the storage position, based on a dynamic jerk-limited motion law;

calculating command instructions to be given to each of the actuators in order to control the movement of the coupling system based on this motion law.

15. A calculation method for a data acquisition and calculation device according to any of the preceding claims, the calculation method comprising:

monitoring in real time the movement of the coupling system;

generating, in real time, from the last determined position of the coupling system, a trajectory of movement of the coupling system in the direction of the target pipe or the storage position, based on a dynamic jerk-limited motion law;

calculating command instructions to be given to each of the actuators in order to control the movement of the coupling system based on this motion law.

16. The calculation method according to claim 15, further comprising predicting at least one of (i) the progress of the movement of the coupling system and (ii) the behavior of the articulated loading arm in relation to the movement command that is applied to it, and adjusting the dynamic jerk-limited motion law so that it takes the prediction into account.

17. An articulated loading arm comprising a fluid transfer line equipped at one of its ends with a coupling system adapted to be coupled to a target pipe, and a control device according to any of claims 1 through 13.

18. The device according to claim 4, wherein the measurement means comprises a number of inertial units.

* * * * *